US005885930A

United States Patent [19]

Brock et al.

[11] Patent Number: 5,885,930

[45] Date of Patent: Mar. 23, 1999

[54] THIN WEAR RESISTANT AND HEAT CONDUCTIVE SLIP LAYER FOR A REUSABLE THERMAL DYE DONOR BELT

[75] Inventors: George W. Brock, La Jolla; Jeremiah F. Connolly, San Diego, both of Calif.

[73] Assignee: Eastman Kodak Company, Rochester, N.Y.

[21] Appl. No.: 903,400

[22] Filed: Jul. 30, 1997

[51] Int. Cl.[6] ..... B41M 5/035; B41M 5/38

[52] U.S. Cl. ..... 503/227; 428/195; 428/209; 428/216; 428/333; 428/692; 428/913; 428/914

[58] Field of Search ..... 503/227; 8/471; 428/195, 913, 914, 209, 212, 213, 215, 216, 333, 692

[56] References Cited

U.S. PATENT DOCUMENTS

| | | | |
|---|---|---|---|
| 3,353,166 | 11/1967 | Brock | 340/174.1 |
| 3,460,968 | 8/1969 | Bate et al. | 117/62 |
| 3,498,837 | 3/1970 | Alstad et al. | 117/239 |
| 4,124,736 | 11/1978 | Patel et al. | 428/622 |
| 4,268,369 | 5/1981 | Barlow et al. | 204/192 D |
| 4,323,629 | 4/1982 | Kunioda et al. | 428/457 |
| 4,345,909 | 8/1982 | Guth et al. | 8/477 |
| 4,390,562 | 6/1983 | Yanagisawa | 427/11 |
| 4,390,601 | 6/1983 | Ono et al. | 428/412 |
| 4,399,013 | 8/1983 | Sugita et al. | 204/192 N |
| 4,411,963 | 10/1983 | Aine | 428/622 |
| 4,554,217 | 11/1985 | Grimm et al. | 428/469 |

*Primary Examiner*—Bruce H. Hess
*Attorney, Agent, or Firm*—William F. Noval

[57] ABSTRACT

A thermal printing donor sheet comprising a support having first and second opposing surfaces; a transferable dye layer on the first surface of the support; and a thermally conductive layer on the second surface of the supporting including a metal undercoat layer with a converted outer layer in the form of a thin wear resistant material.

8 Claims, 2 Drawing Sheets

THIN WEAR RESISTANT AND HEAT CONDUCTIVE SLIP LAYER FOR A REUSABLE THERMAL DYE DONOR BELT

FIELD OF THE INVENTION

This invention relates in general to thermal printing and relates more particularly to a reusable dye donor element for use in thermal dye sublimation printing.

BACKGROUND OF THE INVENTION

Thermal dye sublimation printing is a printing method in which dye from the dye donor element is heat transferred to a receiver sheet selectively in accordance with electrical pulsing of heating resistors in the thermal print head. The print head contains a plurality of resistors, so that the amount of dye transferred is selectively controlled by the intensity and duration of the resistor heating cycle.

The donor sheet includes a very thin support, usually polyester, one side of which is covered with a dye layer carrying the printing dyes.

Because the thin support softens when heated during the printing process and then sticks to the print head causing malfunction and degradation in the printing process, a heat resistant "slip" layer is added to the back of the support. The slip layer usually contains a lubricant and binder.

The slip layers used today consist of polymer layers, which in some cases contain particles of silica, alumina, talc, etc. These layers have poor resistance to continued use due to their thinness. Moreover, they also provide a thermal barrier to heat being transferred across the nip from the print head to the dye layer. It would be desirable that the slip layer provide a wear resistant sliding surface layer which is both thin (on the order of 3 to 10 $\mu$") and is heat conductive.

The formation of thin durable wear resistant coatings has been described in the patent literature. U.S. Pat. No. 3,353,166 describes a plated surface of NiCo, a thickness of 6 $\mu$", which was subjected to a heat treatment of 2 hours at a temperature of 700° F. As a result of this treatment, an oxidized layer of Ni and Co was formed on the surface. The layer was formed in-situ and there was a gradual transformation of the surface from a metal to an oxide, with no distinct separating layer interface.

U.S. Pat. No. 3,460,968 discloses a method of forming an oxide wear resisting layer consisting of $Co_3Cr_4$ on a magnetic layer by placing a high coercivity film in a temperature and humidity chamber until an oxide layer was formed. Humidity level was critical to avoid condensation onto the film.

U.S. Pat. No. 4,554,217 describes the in-situ formation of an oxide on the surface of sputtered or electron beam deposited CoCr, and NiCo by injecting a small amount of $O_2$ into the deposition chamber in the latter stage of deposition. A base film of PET was used in the investigation which was subsequently tested as a floppy disk. Other U.S. Pat. Nos. 4,345,909; 4,399,013; 4,323,629; 4,124,736; 4,268,369; 3,498,837; 4,390,562; 4,390,601; and 4,411,963 address the issue of wear coat formation on flexible surfaces. The Sony Corporation produces a product under the trade name "High 8" consisting of a flexible media with a vacuum deposited coating, which has a layer of oxide formed in-situ during the coating process.

U.S. Pat. No. 4,124,736 describes a metal substrate having a magnetic layer coated with a barrier layer, which is in turn coated with an oxide layer. Cobalt oxide (presumably $Co_3O_4$) is preferred due to its desirable friction resistance.

U.S. Pat. No. 4,268,369 describes the use of $SiO_2$ as an overcoat material on rigid disks. U.S. Pat. No. 4,390,562 describes a disk substrate with a magnetic coating, a magnetic layer, a converted metal into a metal oxide layer, and a rubbed on solid lubricant (namely a fluorocarbon).

None of these patent disclose the use of a heat conductive wear resistant layer as a slip layer for a reusable thermal dye donor element.

There is thus a need for providing in a reusable thermal dye donor belt, a multi-pass slip layer having enhanced wear resistance, while providing good heat conductivity from the thermal head to the dye layers.

SUMMARY OF THE INVENTION

According to the present invention, there is provided a solution to the problems of the prior art.

According to a feature of the present invention, there is provided a thermal printing donor sheet comprising a support having first and second opposing surfaces; a transferable dye layer on the first surface of the support; and a thermally conductive layer on the second surface of the support including a metal undercoat layer with a converted outer layer in the form of a thin, wear resistant material.

ADVANTAGEOUS EFFECT OF THE INVENTION

The invention has the following advantages.

1. The protective wear coating provides strength, durability and long wear to the dye donor belt.
2. The dye donor member can be reinked and reused over and over again.
3. Streaking and cross contamination is avoided through the use of two cleaning stations.
4. The sublimation process is enhanced through the use of a thermoelectric cooler below the belt at the point of inking.

DETAILED DESCRIPTION OF THE INVENTION

Figure 1:
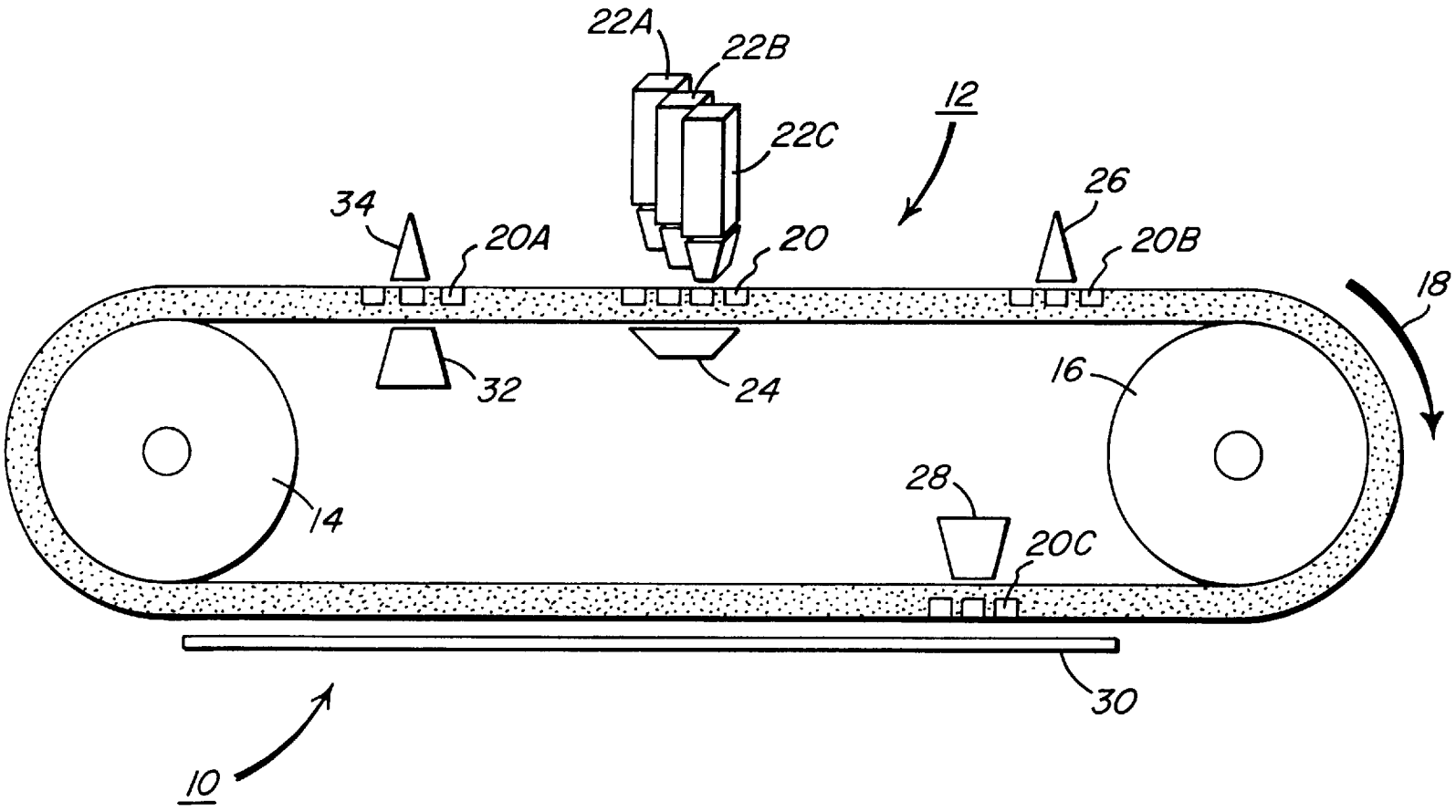
FIG. 1 is a diagrammatic view of a color dye transfer thermal printing system incorporating the present invention.

Referring now to FIG. 1, there is shown a color dye transfer thermal printing system incorporating the present invention. As shown, printer 10 includes a thermal dye donor belt 12 trained around support drums 14 and 16 for movement in the direction of arrow 18. The upper surface of belt 12 includes a matrix of wells 20A, 20B, 20C for respectively containing cyan, yellow, and magenta color dye received from the appropriate color dye cartridges 22A, 22B, and 22C. Three cartridges 22A, 22B, and 22C are respectively provided for cyan, yellow, and magenta dyes. Transfer of dyes from the appropriate cartridge 22 into the corresponding wells 20 of belt 12 can be further aided by thermoelectric cooler 24 on the other side of belt 1. Cooler 24 is a thin film device that can be patterned to further enhance transfer of dye into wells 20.

After dye transfer, the belt 12 is moved under surface cleaning pad 26 to remove any residual dye left on the coated surface to avoid streaking during the print cycle. The active dye area is then moved to a position where thermal print head 28 sublimates the dye from belt 12 to receiver 30. Belt 12 is rotated to another cleaning station where any residual dye is removed from belt 12. This cleaning station includes cleaning print head 32 and cleaning pad 34. Belt 12 is then reinked and reused in successive printing cycles.

Figure 2:
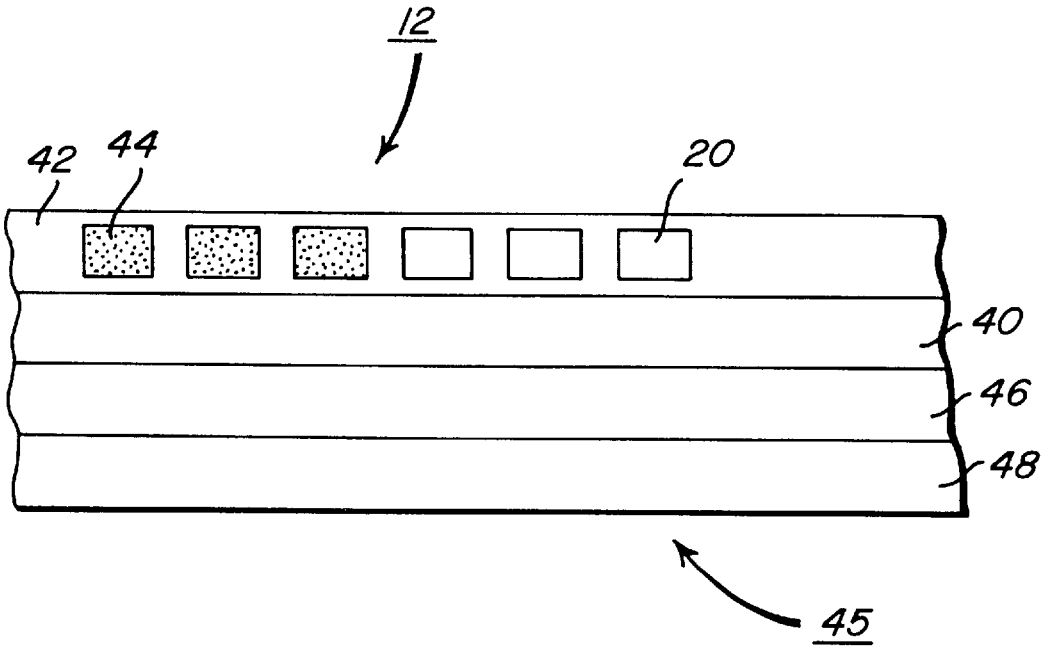
FIG. 2 is a cross-sectional view of the thermal dye donor belt of the system of FIG. 1.

According to the present invention, belt 12 has a slip layer deposited on the back thereof which has enhanced wear resistance while providing good heat conductivity. FIG. 2 is a cross-sectional view of the dye donor belt 12 according to the present invention. As shown, belt 12 includes a support 40 of polyester or other polymeric material, a dye donor layer 42 having wells 20 for containing dye 44, thermally conductive slip layer 45 including a metal inner layer 46, and an outer layer 48. The metal layer 46 can be magnetic, such as cobalt, nickel cobalt, cobalt chromium; or non-magnetic, such as titanium and chromium. The outer layer is a metal oxide, carbide, or nitride.

The slip layer 45 is deposited on support 40 by vacuum deposition or by sputtering. During the latter part of the deposition, a partial pressure of oxygen, carbon, nitrogen, or other reacting gas, is let into the deposition chamber to form the outer layer 48 of an oxide, carbide, or nitride. Layer 45 can be deposited to a thickness of 50 to 125 nanometers while outer layer 48 is 50 to 100 Å.

The slip layer 45 formed of the metal and metal oxide, nitride, carbide, etc. forms a wear resisting layer that readily transmits heat from the contacting thermal head to the dye layer of the donor, and provides for multi-use of the donor material. The magnetic materials also provide means for magnetic recording on the edge of the donor material to enable timing and position marks of the donor relative to the head.

The invention has been described in detail with particular reference to certain preferred embodiments thereof, but it will be understood that variations and modifications can be effected within the spirit and scope of the invention.

PARTS LIST

| PARTS LIST | |
|---|---|
| 10 | printer |
| 12 | dye donor belt |
| 14,16 | support drums |
| 18 | arrow, indicating direction of belt motion |
| 20 | wells |
| 22 | color dye cartridges |
| 24 | thermoelectric cooler |
| 26 | surface cleaning pad |
| 28 | thermal print head |
| 30 | receiver |
| 32 | cleaning print head |
| 34 | cleaning pad |
| 40 | support |
| 42 | dye donor layer |
| 44 | dye |
| 45 | slip layer |
| 46 | metal inner layer |
| 48 | outer oxide layer |

What is claimed is:

1. A thermal printing donor sheet comprising:

a support having first and second opposing surfaces;

a transferable dye layer on said first surface of said support; and a thermally conductive assemblage on said second surface of said support including a metal undercoat layer with a converted outer layer in the form of a thin wear resistant material.

2. The thermal printing donor sheet according to claim 1 wherein the converted outer layer of said thermally conductive assemblage is a metal oxide, carbide, or nitride.

3. The thermal printing donor sheet according to claim 1, wherein said metal undercoat of said thermally conductive assemblage is a magnetic material.

4. The thermal printing donor sheet of claim 3 wherein said magnetic material includes nickel, cobalt or cobalt chromium.

5. The thermal printing donor sheet according to claim 1, wherein the thickness of the metal layer of the thermally conductive assemblage is 50 to 125 nanometers, and the thickness of the converted layer is 50 to 100Å.

6. The thermal printing donor sheet of claim 1 wherein said metal undercoat of said thermally conductive assemblage is a nonmagnetic material.

7. The thermal printing donor sheet of claim 6 wherein said monmagnetic material includes titanium or chromium.

8. The thermal printing donor sheet of claim 1 wherin said support forms a continous loop.

* * * * *